US011432100B2

(12) United States Patent
Roussel et al.

(10) Patent No.: US 11,432,100 B2
(45) Date of Patent: Aug. 30, 2022

(54) METHOD FOR THE SPATIALIZED SOUND REPRODUCTION OF A SOUND FIELD THAT IS AUDIBLE IN A POSITION OF A MOVING LISTENER AND SYSTEM IMPLEMENTING SUCH A METHOD

(71) Applicant: ORANGE, Issy-les-Moulineaux (FR)

(72) Inventors: Georges Roussel, Chatillon (FR); Rozenn Nicol, Chatillon (FR)

(73) Assignee: ORANGE, Issy-les-Moulineaux (FR)

( * ) Notice: Subject to any disclaimer, the term of this patent is extended or adjusted under 35 U.S.C. 154(b) by 0 days.

(21) Appl. No.: 17/270,528

(22) PCT Filed: Aug. 22, 2019

(86) PCT No.: PCT/FR2019/051952
§ 371 (c)(1),
(2) Date: Feb. 23, 2021

(87) PCT Pub. No.: WO2020/043979
PCT Pub. Date: Mar. 5, 2020

(65) Prior Publication Data

US 2021/0360363 A1 Nov. 18, 2021

(30) Foreign Application Priority Data

Aug. 29, 2018 (FR) ..... 1857774

(51) Int. Cl.
*H04S 7/00* (2006.01)
*H04R 1/40* (2006.01)
*H04R 3/00* (2006.01)

(52) U.S. Cl.
CPC ..... *H04S 7/303* (2013.01); *H04R 1/403* (2013.01); *H04R 3/005* (2013.01); *H04S 7/301* (2013.01);
(Continued)

(58) Field of Classification Search
CPC ..... H04S 7/301; H04S 7/303; H04S 2400/13; H04S 2420/01; H04R 1/403; H04R 3/005
(Continued)

(56) References Cited

U.S. PATENT DOCUMENTS 10,231,072 B2 3/2019 Takahashi
2010/0323793 A1* 12/2010 Andall ..... H04S 7/303 463/43
(Continued)

FOREIGN PATENT DOCUMENTS

AU PR647501 8/2001
EP 2056627 A1 5/2009
(Continued)

OTHER PUBLICATIONS

Chinese Office Action, including search report dated Dec. 31, 2021 for related Chinese Application No. 201980065289.6.
(Continued)

*Primary Examiner* — William A Jerez Lora
(74) *Attorney, Agent, or Firm* — David D. Brush; Westman, Champlin & Koehler, P.A.

(57) ABSTRACT

A computer-assisted method for spatialized sound reproduction based on an array of loudspeakers, for the purpose of producing a selected sound field at a position of a listener. The method includes iteratively and continuously: obtaining a current position of a listener; determining respective acoustic transfer functions of the loudspeakers at a virtual microphone of which the position is defined dynamically as a function of the current position of the listener, estimating a sound pressure at the virtual microphone; calculating an error between the estimated sound pressure and a target sound pressure; calculating and applying respective weights to the control signals of the loudspeakers as a function of the error and of a weight forgetting factor, the forgetting factor
(Continued)

being calculated as a function of a movement of the listener, and calculating the sound pressure at the current position of the listener.

12 Claims, 6 Drawing Sheets

(52) U.S. Cl.
CPC ..... *H04S 2400/13* (2013.01); *H04S 2420/01* (2013.01)

(58) Field of Classification Search
USPC ..... 381/1, 5, 10, 56, 58, 59, 105, 107, 108, 381/303
See application file for complete search history.

(56) References Cited

U.S. PATENT DOCUMENTS

2015/0223002 A1* 8/2015 Mehta ..... H04S 7/30 381/303
2015/0230041 A1* 8/2015 Fejzo ..... H04S 7/303 381/303
2017/0034642 A1 2/2017 Takahashi
2017/0295446 A1* 10/2017 Thagadur Shivappa ..... H04S 7/304
2018/0233123 A1* 8/2018 Jin ..... H04R 3/02

FOREIGN PATENT DOCUMENTS

JP 2015206989 A 11/2015
WO 2012068174 A2 5/2012
WO 2013149867 A1 10/2013

OTHER PUBLICATIONS

International Search Report dated Oct. 24, 2019 for corresponding International Application No. PCT/FR2019/051952, dated Aug. 22, 2019.
Written Opinion of the International Searching Authority dated Oct. 24, 2019 for corresponding International Application No. PCT/FR2019/051952, filed Aug. 22, 2019.
Branko Kovacevic et al., "Finite Impulse Response Adaptive Filters with Variable Forgetting Factor", In: Adaptive Digital Filters, Bedin, Heidelberg, : Springer Berlin Heidelberg, pp. 75-108, Jan. 1, 2013 (Jan. 1, 2013), XP055582442.
English translation of the Written Opinion of the International Searching Authority dated Nov. 11, 2019 for corresponding International Application No. PCT/FR2019/051952, filed Aug. 22, 2019.

* cited by examiner to FIG. 2b to FIG. 4b

METHOD FOR THE SPATIALIZED SOUND REPRODUCTION OF A SOUND FIELD THAT IS AUDIBLE IN A POSITION OF A MOVING LISTENER AND SYSTEM IMPLEMENTING SUCH A METHOD

CROSS-REFERENCE TO RELATED APPLICATIONS

This Application is a Section 371 National Stage Application of International Application No. PCT/FR2019/051952, filed Aug. 22, 2019, the content of which is incorporated herein by reference in its entirety, and published as WO 2020/043979 on Mar. 5, 2020, not in English.

FIELD OF THE INVENTION

The invention relates to the field of spatialized audio and the control of sound fields. The aim of the method is to reproduce at least one sound field in an area, for a listener, according to the position of the listener. In particular, the aim of the method is to reproduce the sound field while taking into account the listener's movements.

The area is covered by an array of loudspeakers, supplied respective control signals so that each one continuously emits an audio signal. A respective weight is applied to each control signal of the loudspeakers in order to reproduce the sound field according to the listener's position. A set of filters is determined from the weights, each filter of the set of filters corresponding to each loudspeaker. The signal to be distributed to the listener is then filtered by the set of filters and produced by the loudspeaker corresponding to the filter.

BACKGROUND OF THE INVENTION

The iterative methods used make use of the weights calculated in the previous iteration to calculate the new weights. The set of filters therefore has a memory of the previous iterations. When the listener moves, part of the sound field that was reproduced in the previous iteration (or at the old position of the listener) is missing from the new position of the listener. It is therefore no longer a constraint and the portion of the weights enabling this previous reproduction is no longer useful but remains in memory. In other words, the sound field reproduced at the previous position of the listener, in the previous iteration, is no longer useful for calculating the weights at the current position of the listener, or in the current iteration, but remains in memory.

The present invention improves the situation.

SUMMARY

To this end, it proposes a computer-assisted method for spatialized sound reproduction based on an array of loudspeakers covering an area, for the purpose of producing a selected sound field that is audible in at least one position of at least one listener in the area, wherein the loudspeakers are supplied respective control signals so that each loudspeaker emits an audio signal continuously, the method iteratively and continuously comprising for each listener:

- obtaining the current position of a listener in the area by means of a position sensor;
- determining distances between at least one point of the area and respective positions of the loudspeakers, in order to deduce the respective acoustic transfer functions of the loudspeakers at said point, the position of said point being defined dynamically as a function of the current position of the listener, said point corresponding to a virtual microphone position,
- estimating a sound pressure at said virtual microphone, at least as a function of the respective control signals of the loudspeakers, and of a respective initial weight of the control signals of the loudspeakers;
- calculating an error between said estimated sound pressure and a desired target sound pressure at said virtual microphone;
- calculating and applying respective weights to the control signals of the loudspeakers, as a function of said error and of a weight forgetting factor, said forgetting factor being calculated as a function of a movement of the listener, said movement being determined by a comparison between a previous position of the listener and the current position of the listener;
- the calculation of the sound pressure at the position of the listener being re-implemented as a function of the accordingly weighted respective control signals of the loudspeakers.

The method is therefore based directly on the movement of the listener for varying the forgetting factor at each iteration. This makes it possible to attenuate the memory effect due to the weight calculations in the preceding iterations. The precision in the reproduction of the field is thus greatly improved, while not requiring computational resources that are too costly.

According to one embodiment, a plurality of points forming the respective positions of a plurality of virtual microphones is defined in the area in order to estimate a plurality of respective sound pressures in the area by taking into account the respective weight applied to each loudspeaker, each respectively comprising a forgetting factor, and transfer functions specific to each loudspeaker at each virtual microphone, the plurality of points being centered on the position of the listener.

In this manner, the sound pressure is estimated at a plurality of points in the area surrounding the listener. This makes it possible to apply weights to each loudspeaker, taking into account the differences in sound pressure that may arise at different points in the area. The estimation of sound pressures around the listener is therefore carried out in a homogeneous and precise manner, which allows increasing the precision of the method.

According to one embodiment, the area comprises a first sub-area in which the selected sound field is to be rendered audible and a second sub-area in which the selected sound field is to be rendered inaudible, the first sub-area being defined dynamically as corresponding to the position of the listener and of said virtual microphone, the virtual microphone being a first virtual microphone, and the second sub-area being defined dynamically as being complementary to the first sub-area, the second sub-area being covered by at least a second virtual microphone of which the position is defined dynamically as a function of said second sub-area, the method further comprising iteratively:

- estimating a sound pressure in the second sub-area, at least as a function of the respective control signals of the loudspeakers, and of a respective initial weight of the control signals of the loudspeakers;
- calculating an error between said estimated sound pressure in the second sub-area and a desired target sound pressure in the second sub-area;
- calculating and applying respective weights to the control signals of the loudspeakers, as a function of said error and of a weight forgetting factor, said forgetting factor being calculated as a function of a movement of the listener, said movement being determined by a comparison between a previous position of the listener and the current position of the listener;

the calculation of the sound pressure in the second sub-area being re-implemented as a function of the respective weighted control signals of the loudspeakers.

The method therefore makes it possible to reproduce different sound fields in the same area by using the same loudspeaker system, as a function of a movement of the listener. Thus, at each iteration, the sound field actually reproduced in the two sub-areas is evaluated so that, at each movement of the listener, the sound pressure in each of the sub-areas actually reaches the target sound pressure. The position of the listener can make it possible to determine the sub-area in which the sound field is to be rendered audible. The sub-area in which the sound field is to be rendered inaudible is then defined dynamically at each movement of the listener. The forgetting factor is therefore calculated iteratively for each of the two sub-areas, such that the sound pressure in each of the sub-areas reaches its target sound pressure.

According to one embodiment, the area comprises a first sub-area in which the selected sound field is to be rendered audible and a second sub-area in which the selected sound field is to be rendered inaudible, the second sub-area being defined dynamically as corresponding to the position of the listener and of said virtual microphone, the virtual microphone being a first virtual microphone, and the first sub-area being defined dynamically as being complementary to the second sub-area, the first sub-area being covered by at least a second virtual microphone of which the position is defined dynamically as a function of said first sub-area, the method further comprising iteratively:

estimating a sound pressure in the second sub-area, at least as a function of the respective control signals of the loudspeakers, and of a respective initial weight of the control signals of the loudspeakers;

calculating an error between said estimated sound pressure in the second sub-area and a desired target sound pressure in the second sub-area;

calculating and applying respective weights to the control signals of the loudspeakers, as a function of said error and of a weight forgetting factor, said forgetting factor being calculated as a function of a movement of the listener, said movement being determined by a comparison between a previous position of the listener and the current position of the listener;

the calculation of the sound pressure in the second sub-area being re-implemented as a function of the respective weighted control signals of the loudspeakers.

Similarly, the position of the listener can make it possible to define the sub-area in which the sound field is to be rendered inaudible. The sub-area in which the sound field is to be rendered audible is defined dynamically as complementary to the other sub-area. The forgetting factor is therefore calculated iteratively for each of the two sub-areas, such that the sound pressure in each of the sub-areas reaches its target sound pressure.

According to one embodiment, each sub-area comprises at least one virtual microphone and two loudspeakers, and preferably each sub-area comprises at least ten virtual microphones and at least ten loudspeakers.

The method is therefore able to function with a plurality of microphones and of loudspeakers.

According to one embodiment, the value of the forgetting factor increases if the listener moves and decreases if the listener does not move.

The increase in the forgetting factor when the listener moves makes it possible to forget more quickly the weights calculated in the previous iterations. In contrast, the decrease in the forgetting factor when the listener does not move makes it possible to at least partially retain the weights calculated in the previous iterations.

According to one embodiment, the forgetting factor is defined by $$\gamma(n) = \gamma_{max} \times \left(\frac{m}{\chi}\right)^{\alpha}$$

where $\gamma(n)$ is the forgetting factor, n the current iteration. $\gamma_{max}$ the maximum forgetting factor, $\chi$ a parameter defined by the designer equal to an adaptation increment $\mu$, m a variable defined as a function of a movement of the listener having $\chi$ as its maximum, and $\alpha$ a variable to enable adjusting the rate of increase or decrease of the forgetting factor.

The forgetting factor is thus estimated directly as a function of a movement of the listener. In particular, the forgetting factor depends on the distance traveled by the listener at each iteration, in other words on the movement speed of the listener. A different forgetting factor can therefore be estimated for each listener. The values of the variables can also be adjusted during the iterations so that the movement of the listener is truly taken into account.

According to one embodiment, an upward increment $l_u$ and a downward increment $l_d$ of the forgetting factor are defined such that:

if a movement of the listener is determined, $m=\min(m+l_u, 1)$ if no movement of the listener is determined, $m=\max(m-l_d, 0)$, where $0<l_u<1$ and $0<l_d<1$, the upward and downward increments being defined as a function of a listener's movement speed and/or of a modification of the sound field selected for reproduction.

The definition of two distinct variables $l_u$ and $l_d$ allows the reaction rates of the method to be selected as a function of the start and/or end of the listener's movement.

According to one embodiment, the forgetting factor is between 0 and 1.

This makes it possible to forget the previous weights entirely or to retain the previous weights entirely.

The invention also relates to a spatialized sound reproduction system based on an array of loudspeakers covering an area, for the purpose of producing a selected sound field that is selectively audible at a listener's position in the area, characterized in that it comprises a processing unit suitable for processing and implementing the method according to the invention.

The invention also relates to a storage medium for a computer program loadable into a memory associated with a processor, and comprising portions of code for implementing a method according to the invention during execution of said program by the processor.

BRIEF DESCRIPTION OF THE DRAWINGS

Other features and advantages of the invention will become apparent from reading the following detailed description of some exemplary embodiments of the invention, and from examining the appended drawings in which.

DETAILED DESCRIPTION OF ILLUSTRATIVE EMBODIMENTS

The embodiments described with reference to the figures may be combined.

Figure 1:
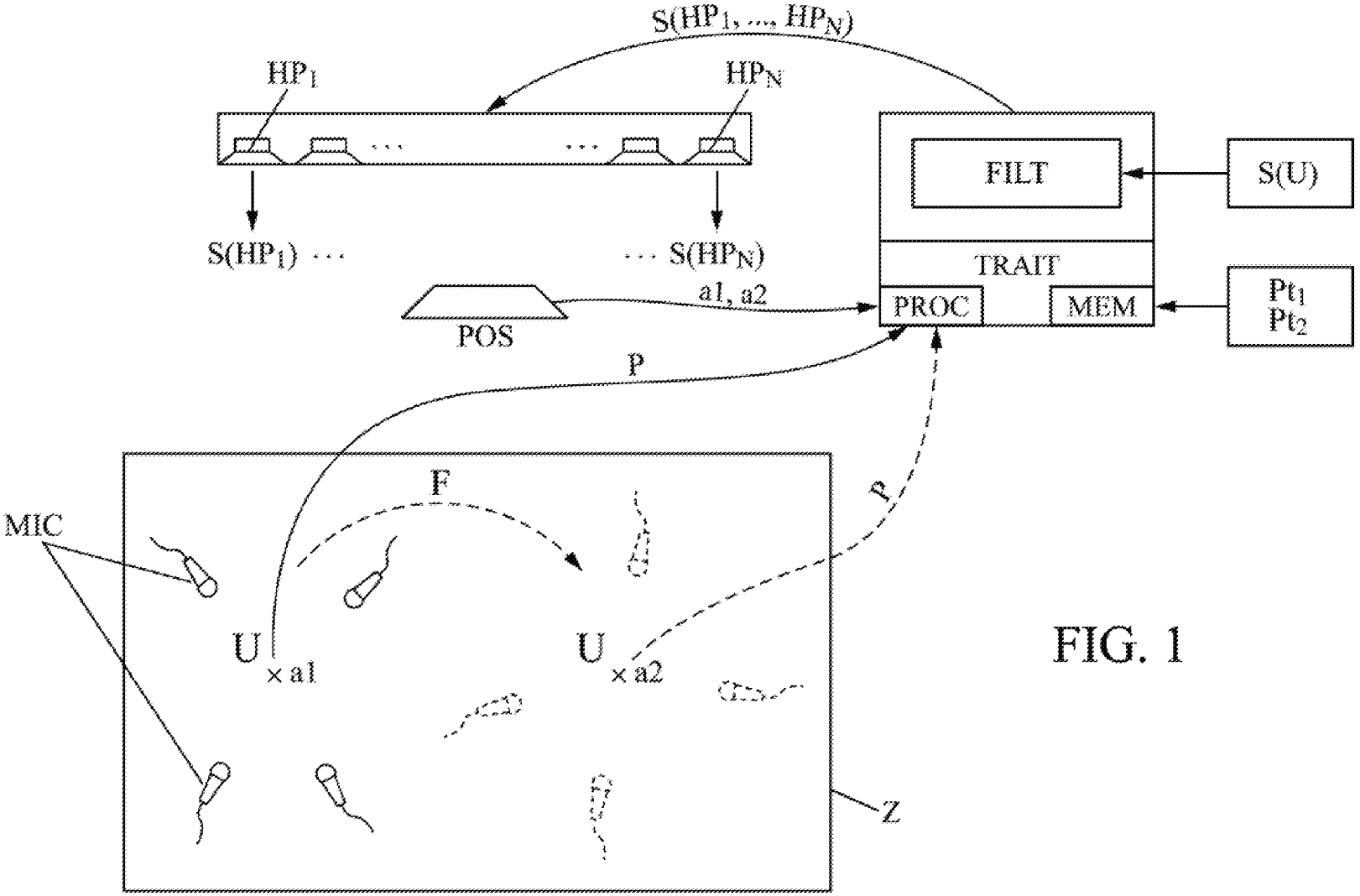
FIG. 1 represents an example of a system according to one embodiment of the invention.

FIG. 1 schematically illustrates a system SYST according to one exemplary embodiment. The system SYST comprises an array of loudspeakers HP comprising N loudspeakers ($HP_1$, . . . , $HP_N$), where N is at least equal to 2, and preferably at least equal to 10. The array of loudspeakers HP covers an area Z. The loudspeakers HP are supplied with respective control signals so that each one emits a continuous audio signal, for the purpose of spatialized sound production of a selected sound field in the area Z. More precisely, the selected sound field is to be reproduced at a position a1 of a listener U. The loudspeakers can be defined by their position in the area. The position a1 of the listener U can be obtained by means of a position sensor POS.

The area is further covered by microphones MIC. In one exemplary embodiment, the area is covered by an array of M microphones MIC, where M is at least equal to 1 and preferably at least equal to 10. In one particular embodiment, the microphones MIC are virtual microphones. In the remainder of the description the term "microphone MIC" is used, with the microphones able to be real or virtual. The microphones MIC are identified by their position in the area Z.

In one exemplary embodiment, the virtual microphones are defined as a function of the position a1 of the listener U in the area Z. In particular, the virtual microphones MIC may be defined so that they surround the listener U. In this exemplary embodiment, the position of the virtual microphones MIC changes according to the position a1 of the listener U.

As illustrated in FIG. 1, the array of microphones MIC surrounds the position a1 of the listener U. Then, when the listener U moves to position a2, the array of microphones MIC is redefined to surround position a2 of the listener. The movement of the listener U is schematically indicated by the arrow F.

The system SYST further comprises a processing unit TRAIT capable of implementing the steps of the method. The processing unit TRAIT comprises a memory in particular, forming a storage medium for a computer program comprising portions of code for implementing the method described below with reference to FIGS. 2*a* and 2*b*. The processing unit TRAIT further comprises a processor PROC capable of executing the portions of code of the computer program.

The processing unit TRAIT receives, continuously and in real time, the position of the microphones MIC, the position of the listener U, the positions of each loudspeaker HP, the audio signal to be reproduced S(U) intended for the listener U, and the target sound field $P_t$ to be achieved at the position of the listener. The processing unit TRAIT also receives the estimated sound pressure P at the position of the listener U. From these data, the processing unit TRAIT calculates the filter FILT to be applied to the signal S in order to reproduce the target sound field $P_t$. The processing unit TRAIT outputs the filtered signals S($HP_1$ . . . $HP_N$) to be respectively produced by the loudspeakers $HP_1$ to $HP_N$.

Figure 2A:
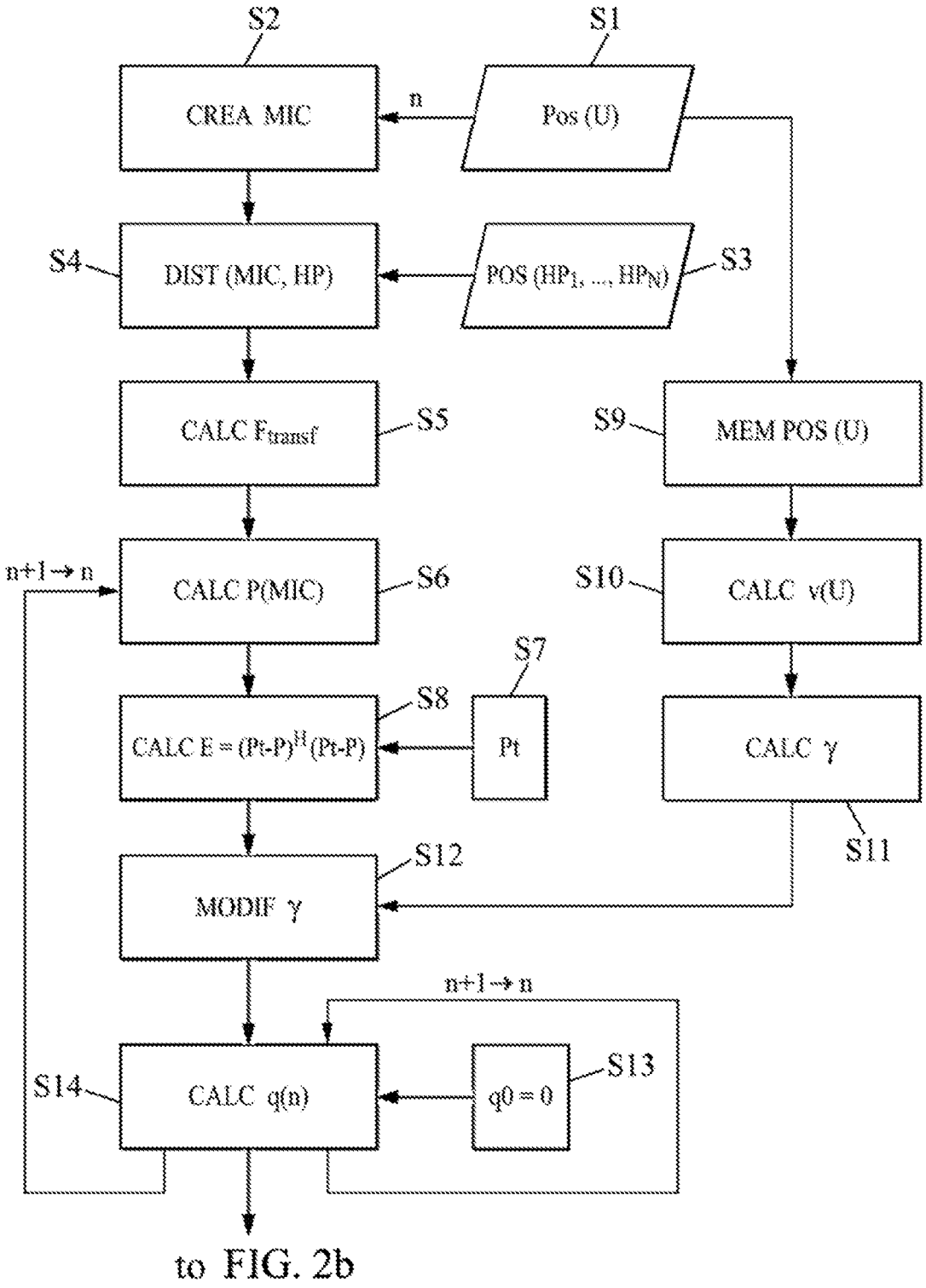
FIGS. 2*a* and 2*b* illustrate, in the form of a flowchart, the main steps of one particular embodiment of the method, FIG. 3 schematically illustrates one embodiment in which two sub-areas are dynamically defined as a function of the geolocation data of a listener.
Figure 2B:
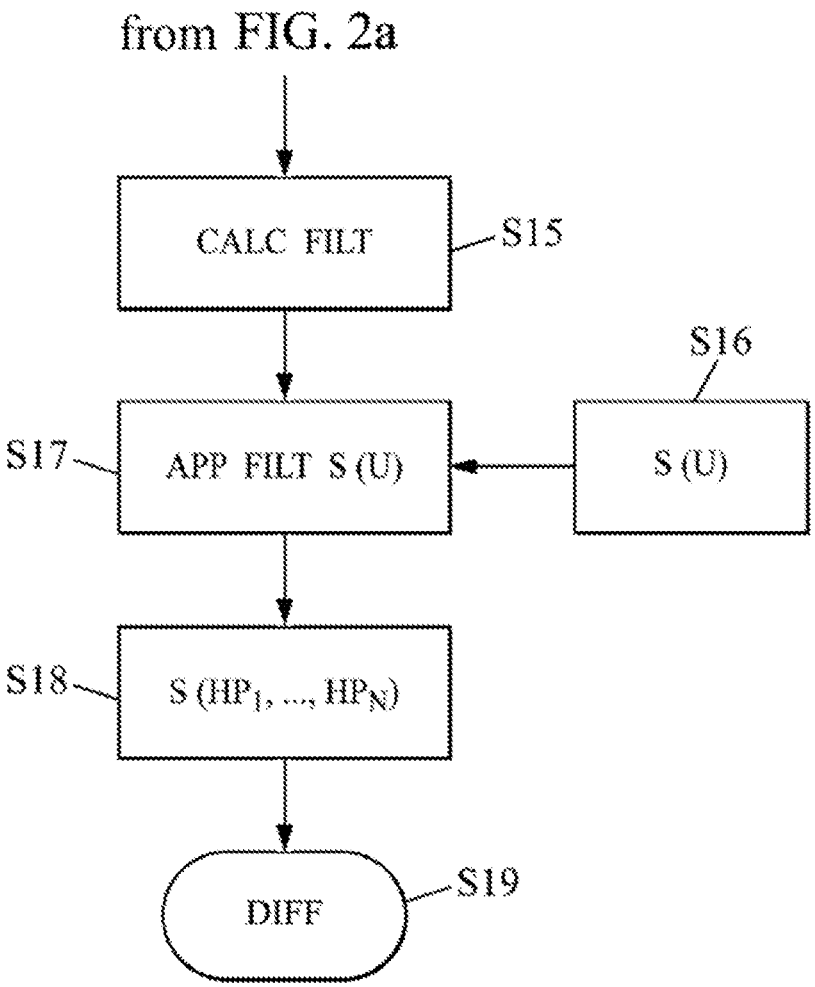

FIGS. 2*a* and 2*b* illustrate the main steps of a method for reproducing a selected sound field at a position of a listener, when the listener is moving. The steps of the method are implemented continuously and in real time by the processing unit TRAIT.

In step S1, the position of the listener U in the area is obtained by means of a position sensor. From these geolocation data, an array of virtual microphones MIC is defined in step S2. The array of virtual microphones MIC can take any geometric shape such as a square, a circle, a rectangle, etc. The array of virtual microphones MIC may be centered around the position of the listener U. The array of virtual microphones MIC defines for example a perimeter of a few tens of centimeters to a few tens of meters around the listener U. The array of virtual microphones MIC comprises at least two virtual microphones, and preferably at least ten virtual microphones. The number of virtual microphones as well as their arrangement define limits to the reproduction quality in the area.

In step S3, the position of each loudspeaker HP is determined. In particular, the area comprises an array of loudspeakers comprising at least two loudspeakers HP. Preferably, the array of loudspeakers comprises about ten loudspeakers HP. The loudspeakers HP may be distributed within the area so that the entire area is covered by the loudspeakers.

In step S4, a distance between each loudspeaker HP/microphone MIC pair is calculated. This makes it possible to calculate each of the transfer functions Ftransf for each loudspeaker HP/microphone MIC pair, in step S5.

More precisely, the target sound field can be defined as a vector Pt(ω, n) for the sets of microphones MIC, at each instant n for a pulse $\omega=2\pi f$, f being the frequency. The virtual microphones $MIC_1$ to $MIC_M$ of the array of virtual microphones are arranged at positions $x_{MIC}=[MIC_1, \ldots, MIC_M]$ and capture a set of sound pressures grouped together in vector P(ω, n).

The sound field is reproduced by the loudspeakers ($HP_1, \ldots, HP_N$), which are fixed and have as their respective position $x_{HP}=[HP_1, \ldots, HP_N]$. The loudspeakers ($HP_1, \ldots, HP_N$) are controlled by a set of weights grouped in vector $q(\omega, n)=[q_1(\omega, n), \ldots, q_N(\omega, n)]^T$. The exponent $^T$ is the transposition operator.

The sound field propagation path between each loudspeaker HP/microphone MIC pair can be defined by a set of transfer functions G(ω, n) grouped in the matrix:

$$G(\omega, n) = \begin{bmatrix} G_{11}(\omega, n) & \cdots & G_{1N}(\omega, n) \\ \vdots & \ddots & \vdots \\ G_{M1}(\omega, n) & \cdots & G_{MN}(\omega, n) \end{bmatrix}$$

with the transfer functions defined as being:

$$G_{ml} = \frac{j\rho ck}{4\pi R_{ml}} e^{-jkR_{ml}},$$

where $R_{ml}$ is the distance between a loudspeaker/microphone pair, k the wavenumber, ρ the density of the air, and c the speed of sound.

In step S6, the sound pressure P is determined at the position of the listener U. More precisely, the sound pressure P is determined within the perimeter defined by the array of virtual microphones MIC. Even more precisely, the sound pressure P is determined at each virtual microphone. The sound pressure P is the sound pressure resulting from the signals produced by the loudspeakers in the area. The sound pressure P is determined from the transfer functions Ftransf calculated in step S5, and from a weight applied to the control signals supplied to each loudspeaker. The initial weight applied to the control signals of each loudspeaker is zero. This corresponds to the weight applied in the first iteration. Then, with each new iteration, the weight applied to the control signals tends to vary as described below.

In this example, the sound pressure P comprises all the sound pressures determined at each of the positions of the virtual microphones. The sound pressure estimated at the position of the listener U is thus more representative. This makes it possible to obtain a homogeneous result as output from the method.

Step S7 makes it possible to define the value of the target sound pressure Pt at the position of the listener U. More precisely, the value of the target sound pressure Pt is initialized at this step. The target sound pressure Pt can be selected by the designer. It is then transmitted to the processing unit TRAIT in the form of the vector defined above.

In step S8, the error between the target pressure Pt and the estimated pressure P at the position of the listener U is calculated. The error may be due to the fact that an adaptation increment μ is applied so that the target pressure Pt is not immediately reached. The target pressure Pt is reached after a certain number of iterations of the method. This makes it possible to minimize the computational resources required to reach the target pressure at the position of the listener U. This also makes it possible to ensure the stability of the algorithm. Similarly, the adaptation increment μ is also selected so that the error calculated in step S8 has a small value, in order to stabilize the filter.

The error E(n) is calculated as follows:

$$E(n)=G(n)q(n)-p_T(n)=p(n)-p_T(n)$$

In step S12, the forgetting factor γ(n) is calculated in order to calculate the weights to be applied to each control signal of the loudspeakers.

The forgetting factor γ(n) has two roles. On the one hand, it makes it possible to regularize the problem. In other words, it makes it possible to prevent the method from diverging when it is in a stationary state.

On the other hand, the forgetting factor γ(n) makes it possible to attenuate the weights calculated in the preceding iterations. Thus, when the listener moves, the previous weights do not influence future weights.

The forgetting factor γ(n) is determined by basing it directly on a possible movement of the listener. This calculation is illustrated in steps S9 to S11. In step S9, the position of the listener in the previous iterations is retrieved. For example, it is possible to retrieve the position of the listener in all previous iterations. Alternatively, it is possible to retrieve the position of the listener for only a portion of the previous iterations, for example the last ten or the last hundred iterations.

From these data, a movement speed of the listener is calculated in step S10. The movement speed may be calculated in meters per iteration. The speed of the listener may be zero.

In step S11, the forgetting factor γ(n) is calculated according to the formula:

$$\gamma(n) = \gamma_{max} \times \left(\frac{m}{\chi}\right)^{\alpha},$$

where γ is the forgetting factor, n the current iteration, $\gamma_{max}$ the maximum forgetting factor, χ a parameter defined by the designer equal to the adaptation increment μ, m a variable defined as a function of a movement of the listener having χ as the maximum, and α a variable allowing adjustment of the rate of increase or decrease of the forgetting factor.

The forgetting factor γ is bounded between 0 and $\gamma_{max}$. According to this definition. $\gamma_{max}$ therefore corresponds to a maximum weight percentage to be forgotten between each iteration.

The choice of the value of m is variable during the iterations. It is chosen so that if the listener moves, then the forgetting factor increases. When there is no movement, it decreases. In other words, when the speed of the listener is positive the forgetting factor increases, and when the speed of the listener is zero it decreases.

The variable α mainly influences the rate of convergence of the method. In other words, it makes it possible to choose the number of iterations at which the maximum and/or minimum value $\gamma_{max}$ of the forgetting factor is reached.

The variable m is defined as follows:

if movement of the listener is determined, $m=\min(m+l_u, 1)$ if no movement of the listener is determined, $m=\max(m-l_d, 0)$.

The variables $l_u$ and $l_d$ respectively correspond to an upward increment and a downward increment of the forgetting factor. They are defined as a function of the speed of movement of the listener and/or as a function of a modification of the selected sound field to be reproduced.

In particular, the upward increment $l_u$ has a greater value if the preceding weights are to be forgotten quickly during movement (for example in the case where the listener's speed of movement is high). The downward increment $l_d$ has a greater value if the previous weights are to be forgotten completely at the end of a listener's movement.

The definition of two variables $l_u$ and $l_d$ therefore makes it possible to modulate the system. It makes it possible to incorporate the movement of the listener, continuously and in real time. Thus, at each iteration, the forgetting factor is calculated as a function of the actual movement of the listener, so as to reproduce the selected sound field at the listener's position.

In step S12, the forgetting factor γ is modified if necessary, according to the result of the calculation of step S11.

The calculation and modification of the forgetting factor in step S12 serves to calculate the weights to be applied to the control signals of the loudspeakers. More precisely, in the first iteration, the weights are initialized to zero (step S13). Each loudspeaker produces an unweighted control signal. Then, at each iteration, the value of the weights varies according to the error and to the forgetting factor (step S14). The loudspeakers then produce a weighted control signal, which can be different with each new iteration. This modification of the control signals explains in particular why the sound pressure P estimated at the position of the listener U can be different at each iteration.

The new weights are calculated in step S14 according to the mathematical formula: $q(n+1)=q(n)(1-\mu\gamma(n))+\mu G^H(n)(G(n)q(n)-Pt(n))$, where μ is the adaptation increment which can vary at each iteration and the forgetting factor γ(n) which can vary. In order to guarantee stability of the filter, it is advantageous to avoid the adaptation increment p being greater than the inverse of the greatest eigenvalue of $G^H G$.

In step S15, the filters FILT to be applied to the loudspeakers are calculated. One filter per loudspeaker is calculated for example. There can therefore be as many filters as there are loudspeakers. To obtain filters in the time domain from the weights calculated in the previous step, it is possible to achieve symmetry of the weights calculated in the frequency domain by taking their complex conjugate. Then, an inverse Fourier transform is performed to obtain the filters in the time domain. However, it is possible that the calculated filters do not satisfy the principle of causality. A temporal shift of the filter, corresponding for example to half the filter length, may be performed. A plurality of filters, for example one filter per loudspeaker, is thus obtained.

In step S16, the audio signal to be produced for the listener is obtained. It is then possible to perform real-time filtering of the audio signal S(U) in order to produce the signal on the loudspeakers. In particular, the signal S(U) is filtered in step S17 by the filters calculated in step S15, and produced by the loudspeaker corresponding to the filter in steps S18 and S19.

Then, at each iteration, the filters FILT are calculated as a function of the filtered signals $S(HP_1, \ldots, HP_n)$, weighted in the previous iteration and produced on the loudspeakers, as perceived by the array of microphones. The filters FILT are applied to the signal S(U) in order to obtain new control signals $S(HP_1, \ldots, HP_n)$ to be respectively produced on each loudspeaker of the array of loudspeakers.

The method is then restarted beginning with step S6, in which the sound pressure at the position of the listener is determined.

Another embodiment is described below. The same reference numbers designate the same elements.

In this embodiment, the array of loudspeakers HP covers an area comprising a first sub-area SZ1 and a second sub-area SZ2. The loudspeakers HP are supplied with respective control signals so that each one emits a continuous audio signal, for the purpose of spatialized sound production of a selected sound field. The selected sound field is to be rendered audible in one of the sub-areas, and to be rendered inaudible in the other sub-area. For example, the selected sound field is audible in the first sub-area SZ1. The selected sound field is to be rendered inaudible in the second sub-area SZ2. The loudspeakers may be defined by their position in the area.

Each sub-area SZ may be defined by the position of the listener U. It is then possible to define, as a function of the geolocation data of the listener, the first sub-area SZ1 in which the listener U hears the selected sound field. The sub-area SZ1 has for example predefined dimensions. In particular, the first sub-area may correspond to a surface area of a few tens of centimeters to a few tens of meters, of which the listener U is the center. The second sub-area SZ2, in which the selected sound field is to be rendered inaudible, may be defined as the complementary sub-area.

Alternatively, the position of the listener U may define the second sub-area SZ2, in the same manner as described above. The first sub-area SZ1 is defined as complementary to the second sub-area SZ2.

According to this embodiment, one part of the array of microphones MIC covers the first sub-area SZ1 while the other part covers the second sub-area SZ2. Each sub-area comprises at least one virtual microphone. For example, the area is covered by M microphones Ml to $MIC_M$. The first sub-area is covered by microphones $MIC_1$ to $MIC_N$, with N less than M. The second sub-area is covered by microphones $MIC_{N+1}$ to $MIC_M$.

As the sub-areas are defined as a function of the position of the listener, they evolve as the listener moves. The position of the virtual microphones evolves in the same manner.

Figure 3:
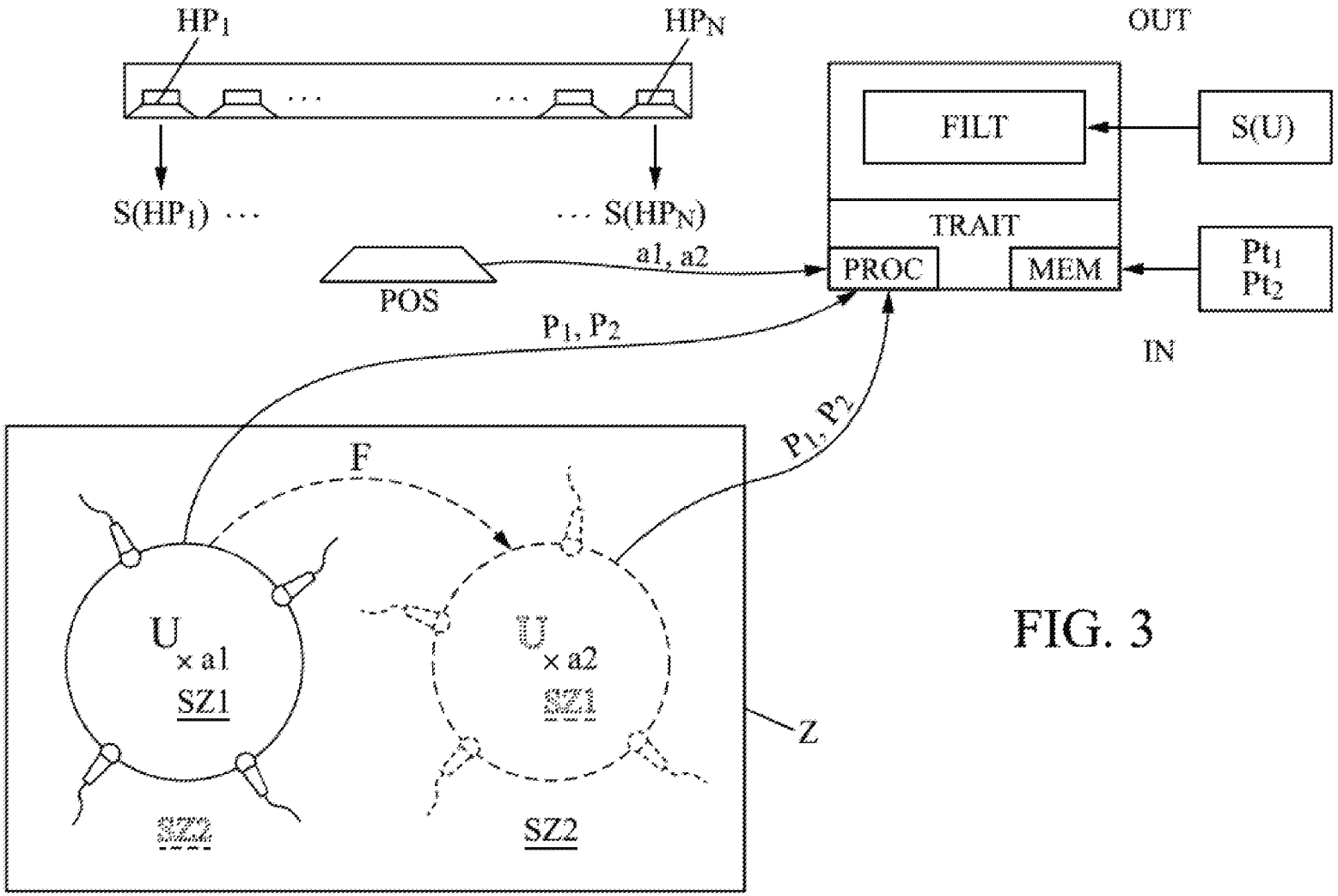

More precisely, and as illustrated in FIG. 3, the first sub-area SZ1 is defined by the position a1 of the listener U (shown in solid lines). The array of microphones MIC is defined so that is covers the first sub-area SZ1. The second sub-area SZ2 is complementary to the first sub-area SZ1. The arrow F illustrates a movement of the listener U to a position a2. The first sub-area SZ1 is then redefined around the listener U (in dotted lines). The array of microphones MIC is redefined to cover the new first sub-area SZ1. The remainder of the area represents the new second sub-area SZ2. The first sub-area SZ1 initially defined by position a1 of the listener is thus located in the second sub-area SZ2.

In the system illustrated in FIG. 3, the processing unit TRAIT thus receives as input the position of the microphones MIC, the geolocation data of the listener U, the positions of each loudspeaker HP, the audio signal to reproduce S(U) intended for the listener U. and the target sound fields $Pt_1$, $Pt_2$ to be achieved in each sub-area. From these data, the processing unit TRAIT calculates the filter FILT to be applied to the signal S(U) in order to reproduce the target sound fields $Pt_1$, $Pt_2$ in the sub-areas. The processing unit TRAIT also receives the sound pressures $Pt_1$, $Pt_2$ estimated in each of the sub-areas. The processing unit TRAIT outputs the filtered signals $S(HP_1 \ldots HP_N)$ to be respectively produced on the loudspeakers $HP_1$ to $HP_N$.

Figure 4A:
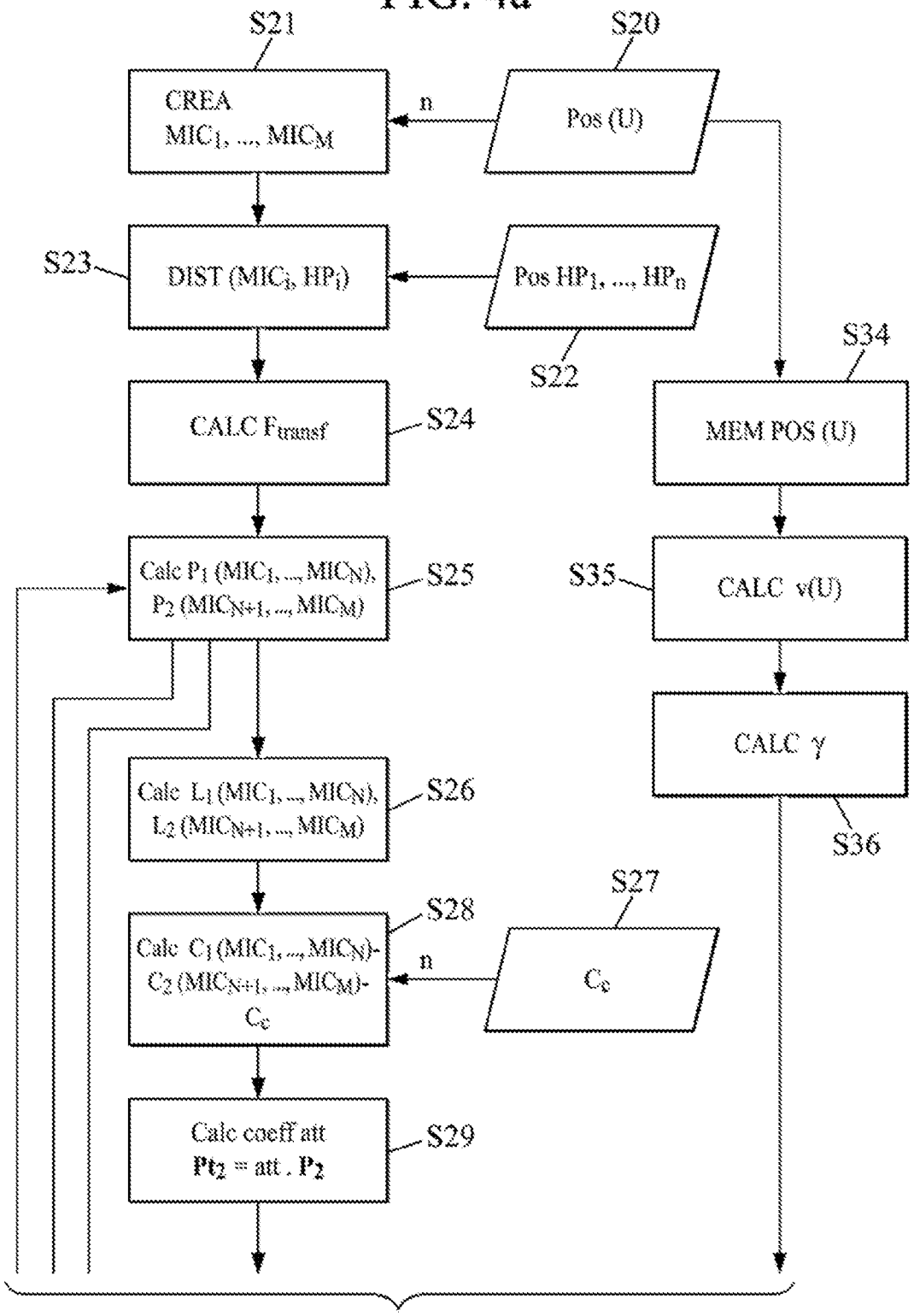
FIGS. 4*a* and 4*b* illustrate, in the form of a flowchart, the main steps of a second embodiment of the method.
Figure 4B:
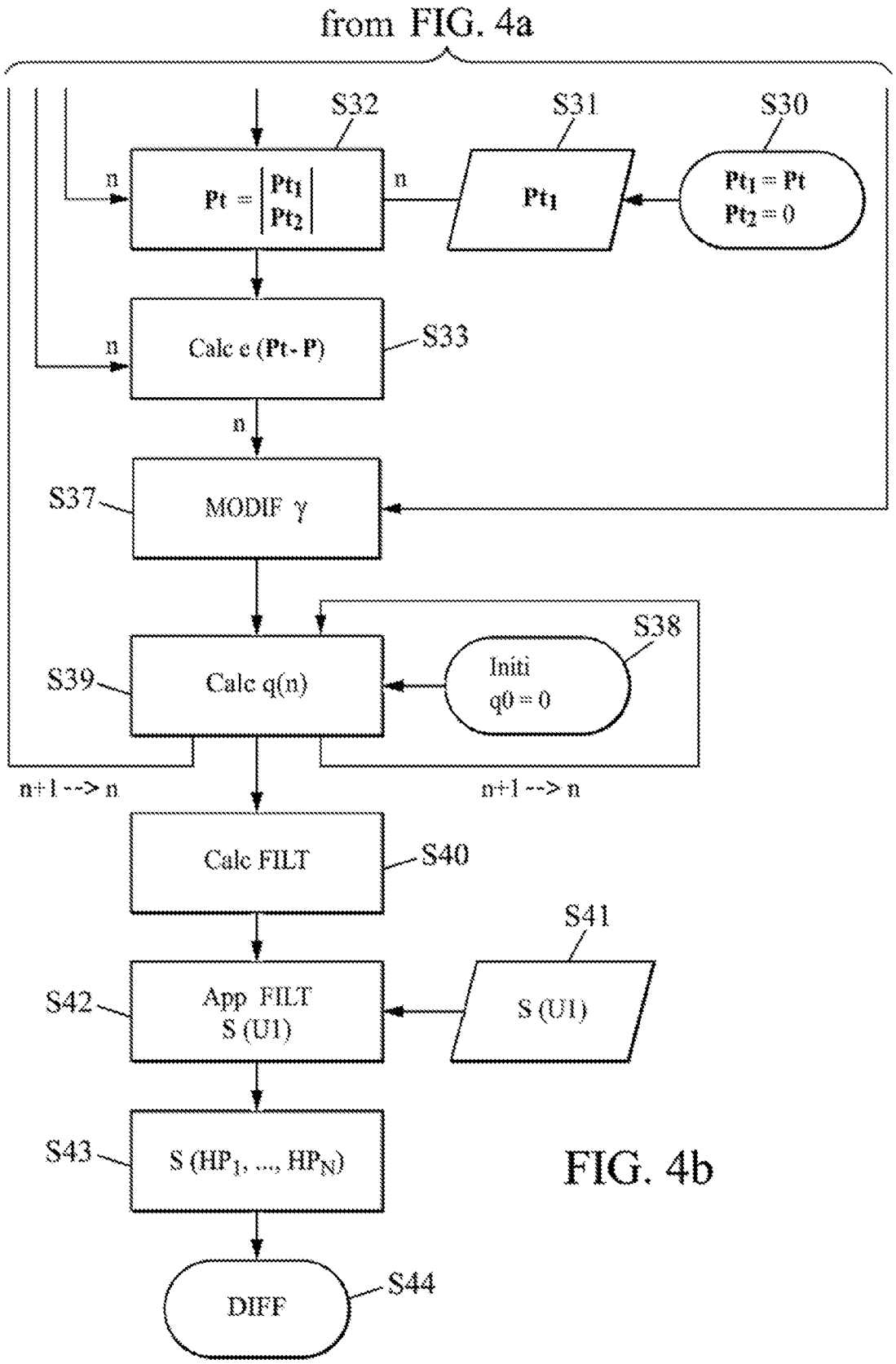

FIGS. 4*a* and 4*b* illustrate the main steps of the method according to the invention. The steps of the method are implemented by the processing unit TRAIT continuously and in real time.

The aim of the method is to render the selected sound field inaudible in one of the sub-areas, for example in the second sub-area SZ2, while following the movement of a listener whose position defines the sub-areas. The method is based on an estimate of sound pressures in each of the sub-areas, so as to apply a desired level of sound contrast between the two sub-areas. At each iteration, the audio signal S(U) is filtered as a function of the estimated sound pressures and the level of sound contrast in order to obtain the control signals $S(HP_1 \ldots HP_N)$ to be produced on the loudspeakers.

In step S20, the position of the listener U is determined, for example by means of a position sensor POS. From this position, the two sub-areas SZ1. SZ2 are defined. For example, the first sub-area corresponds to the position of the listener U. The first sub-area SZ1 is for example defined as being an area of a few tens of centimeters to a few tens of meters in circumference, for which the first listener U1 is the center. The second sub-area SZ2 can be defined as being complementary to the first sub-area SZ1.

Alternatively, it is the second sub-area SZ2 which is defined by the position of the listener, the first sub-area SZ1 being complementary to the second sub-area SZ2.

In step S21, the array of microphones MIC is defined, at least one microphone covering each of the sub-areas SZ1. SZ2.

In step S22, the position of each loudspeaker HP is determined, as described above with reference to FIGS. 2*a* and 2*b*.

In step S23, a distance between each loudspeaker HP and microphone MIC pair is calculated. This makes it possible to calculate each of the transfer functions Ftransf for each loudspeaker HP/microphone MIC pair, in step S24.

More precisely, the target sound field can be defined as a vector $$Pt(\omega, n) = \begin{bmatrix} Pt_1 \\ Pt_2 \end{bmatrix},$$

for the sets of microphones MIC, at each instant n for a pulse $\omega=2\pi f$, f being the frequency. The microphones $MIC_1$ to $MIC_M$ are arranged at positions $x_{MIC}=[MIC_1, \ldots, MIC_M]$ and capture a set of sound pressures grouped in vector $P(\omega, n)$.

The sound field is reproduced by the loudspeakers $(HP_1, \ldots, HP_N)$, which are fixed and have as their respective positions $x_{HP}=[HP_1, \ldots, HP_N]$. The loudspeakers $(HP_1, \ldots, HP_N)$ are controlled by a set of weights grouped in vector $q(\omega, n)=[q_1(\omega, n), \ldots, q_N(\omega, n)]^T$. The exponent $^T$ is the transposition operator.

The sound field propagation path between each loudspeaker HP and microphone MIC pair can be defined by a set of transfer functions $G(\omega, n)$ grouped in the matrix $$G(\omega, n) = \begin{bmatrix} G_{11}(\omega, n) & \cdots & G_{1N}(\omega, n) \\ \vdots & \ddots & \vdots \\ G_{M1}(\omega, n) & \cdots & G_{MN}(\omega, n) \end{bmatrix}$$

with the transfer functions defined as being:

$$G_{ml} = \frac{j\rho ck}{4\pi R_{ml}} e^{-jkR_{ml}},$$

where $R_{ml}$ is the distance between a loudspeaker/microphone pair, k is the wavenumber. ρ the density of the air, and c the speed of sound.

In step S25, the sound pressures $P_1$ and $P_2$ are respectively determined in the first sub-area SZ1 and in the second sub-area SZ2.

According to one exemplary embodiment, the sound pressure $P_1$ in the first sub-area SZ1 can be the sound pressure resulting from the signals produced by the loudspeakers in the first sub-area. The sound pressure $P_2$ in the second sub-area, in which the sound signals are to be rendered inaudible, may correspond to the induced sound pressure resulting from the signals produced by the loudspeakers supplied the control signals associated with the pressure $P_1$ induced in the first sub-area.

The sound pressures $P_1$, $P_2$ are determined from the transfer functions Ftransf calculated in step S24, and from an initial weight applied to the control signals of each loudspeaker. The initial weight applied to the control signals of each of the loudspeakers is zero. The weight applied to the control signals then tends to vary with each iteration, as described below.

According to this exemplary embodiment, the sound pressures $P_1$, $P_2$ each include the set of sound pressures determined at each of the positions of the virtual microphones. The estimated sound pressure in the sub-areas is thus more representative. This makes it possible to obtain a homogeneous result as output from the method.

Alternatively, a sound pressure determined at a single position $P_1$, $P_2$ is respectively estimated for the first sub-area SZ1 and for the second sub-area SZ2. This makes it possible to limit the number of calculations, and therefore to reduce the processing time and consequently the reactivity of the system.

More precisely, the sound pressures $P_1$, $P_2$ in each of the sub-areas can be grouped in the form of a vector defined as:

$$p(\omega, n) = \begin{bmatrix} P_1 \\ P_2 \end{bmatrix} = G(\omega, n)q(\omega, n)$$

In step S26, the sound levels $L_1$ and $L_2$ are determined respectively in the first sub-area SZ1 and in the second sub-area SZ2. The sound levels $L_1$ and $L_2$ are determined at each position of the microphones MIC. This step makes it possible to convert the values of the estimated sound pressures $P_1$, $P_2$ into values which can be measured in decibels. In this manner, the sound contrast between the first and second sub-areas can be calculated. In step S27, a desired sound contrast level $C_C$ between the first sub-area and the second sub-area is defined. For example, the desired sound contrast $C_C$ between the first sub-area SZ1 and the second sub-area SZ2 is defined beforehand by a designer based on the selected sound field and/or the perception of a listener U.

More precisely, the sound level L for a microphone can be defined by $$L = 20 \log_{10}\left(\frac{|P|}{p_0}\right),$$

where $p_0$ is the reference sound pressure, meaning the perception threshold.

Thus, the average sound level in a sub-area can be defined as:

$$L = 10 \log_{10}\left(\frac{P^H P/M}{p_0^2}\right),$$

where $P^H$ is the conjugate transpose of the vector of sound pressures in the sub-area and M is the number of microphones in that sub-area.

From the sound level $L_1$, $L_2$ in the two sub-areas, it is possible to calculate the estimated sound contrast C between the two sub-areas: $C=L_1-L_2$.

In step S28, the difference between the estimated sound contrast between the two sub-areas and the desired sound contrast $C_C$ is calculated. From this difference, an attenuation coefficient can be calculated. The attenuation coefficient is calculated and applied to the estimated sound pressure $P_2$ in the second sub-area, in step S29. More precisely, an attenuation coefficient is calculated and applied to each of the estimated sound pressures $P_2$ at each of the positions of the microphones MIC of the second sub-area SZ2. The target sound pressure $Pt_2$ in the second sub-area then takes the value of the attenuated sound pressure $P_2$ of the second sub-area.

Mathematically, the difference $C_\xi$ between the estimated sound contrast C and the desired sound contrast $C_C$ can be calculated as follows: $C_\xi=C-C_C=L_1-L_2-C_C$. It is then possible to calculate the attenuation coefficient $$\zeta = 10^{\frac{c_\xi}{20}}.$$

This coefficient is determined by the amplitude of the sound pressure to be given to each microphone so that the sound level in the second sub-area is homogeneous. When the contrast is equivalent to that corresponding to the desired sound contrast $C_C$ for a microphone in the second sub-area, then $C_\xi \approx 0$ therefore $\xi \approx 1$. This means that the estimated sound pressure at this microphone corresponds to the target pressure value in the second sub-area.

When the difference between the estimated sound contrast C and the desired sound contrast $C_C$ is negative $C_\xi < 0$, this means that the desired contrast $C_C$ has not yet been reached, and therefore that a lower pressure amplitude must be obtained at this microphone.

When the difference between the estimated sound contrast C and the desired sound contrast $C_C$ is positive $C_\xi > 0$, the sound pressure at this point is too low. It must therefore be increased to match the desired sound contrast in the second sub-area.

The principle is therefore to use the pressure field present in the second sub-area which is induced by the sound pressure in the first sub-area, then to attenuate or amplify the individual values of estimated sound pressures at each microphone, so that they match the target sound field in the second sub-area across all microphones. For all microphones, we define the vector: $\xi = [\xi_1, \ldots, \xi_m, \ldots, \xi_M]^T$.

This coefficient is calculated at each iteration and can therefore change. It can therefore be written in the form $\xi(n)$.

Alternatively, in the case where a single sound pressure $P_2$ is estimated for the second sub-area SZ2, a single attenuation coefficient is calculated and applied to sound pressure $P_2$.

The attenuation coefficients are calculated so as to meet the contrast criterion defined by the designer. In other words, the attenuation coefficient is defined so that the difference between the sound contrast between the two sub-areas SZ2 and the desired sound contrast $C_C$ is close to zero.

Steps S30 to S32 allow defining the value of the target sound pressures $Pt_1$, $Pt_2$ in the first and second sub-areas SZ1, SZ2.

Step S30 comprises the initialization of the target sound pressures $Pt_1$, $Pt_2$, respectively in the first and second sub-areas SZ1. SZ2. The target sound pressures $Pt_1$, $Pt_2$ characterize the target sound field to be produced in the sub-areas. The target sound pressure $Pt_1$ in the first sub-area SZ1 is defined as being a target pressure $Pt_1$ selected by the designer. More precisely, the target pressure $Pt_1$ in the first sub-area SZ1 is greater than zero, so the target sound field is audible in this first sub-area. The target sound pressure $Pt_2$ in the second sub-area is initialized to zero. The target pressures $Pt_1$, $Pt_2$ are then transmitted to the processing unit TRAIT in step S31, in the form of a vector Pt.

At each iteration, new target pressure values are assigned to the target pressures $Pt_1$, $Pt_2$ determined in the previous iteration. This corresponds to step S32. More precisely, the value of target pressure $Pt_1$ in the first sub-area is the value defined in step S30 by the designer. The designer can change this value at any time. The target sound pressure $Pt_2$ in the second sub-area takes the value of the attenuated sound pressure $Pt_2$ (step S29). This allows, at each iteration, redefining the target sound field to be reproduced in the second sub-area, taking into account the listener's perception and the loudspeakers' control signals. The target sound pressure $Pt_2$ of the second sub-area is thus equal to zero only during the first iteration. Indeed, as soon as the loudspeakers produce a signal, a sound field is perceived in the first sub-area but also in the second sub-area.

Mathematically, the target pressure $Pt_2$ in the second sub-area is calculated as follows.

At the first iteration. $Pt_2$ is equal to zero: $Pt_2(0)=0$.

At each iteration, the estimated sound pressure $Pt_2$ in the second sub-area is calculated. This sound pressure corresponds to the sound pressure induced in the second sub-area by radiation from the loudspeakers in the first sub-area. Thus, in each iteration we have: $P_2(\omega, n) = G_2(\omega, n)q(\omega, n)$, where $G_2(\omega, n)$ is the matrix of transfer functions in the second sub-area at iteration n.

The target pressure $Pt_2$ at iteration n+1 can therefore be calculated as $Pt_2(n+1) = \xi(n) \times P_2$.

In step S33, the error between the target pressure $Pt_2$ and the estimated pressure $P_2$ in the second sub-area is calculated. The error is due to the fact that an adaptation increment $\mu$ is applied so that the target pressure $Pt_2$ is not immediately reached. The target pressure $Pt_2$ is reached after a certain number of iterations of the method. This makes it possible to minimize the computational resources required to reach the target pressure $Pt_2$ in the second sub-area SZ2. This also makes it possible to ensure the stability of the algorithm. In the same manner, the adaptation increment $\mu$ is also selected so that the error calculated in step S33 has a small value, in order to stabilize the filter.

The forgetting factor $\gamma(n)$ is then calculated in order to calculate the weights to be applied to each control signal of the loudspeakers.

As described above, the forgetting factor $\gamma(n)$ makes it possible to regularize the problem and to attenuate the weights calculated in the preceding iterations. Thus, when the listener moves, previous weights do not influence future weights.

The forgetting factor $\gamma(n)$ is determined by basing it directly on a possible movement of the listener. This calculation is illustrated in steps S34 to S36. In step S34, the position of the listener in the previous iterations is retrieved. For example, it is possible to retrieve the position of the listener in all previous iterations. Alternatively, it is possible to retrieve the position of the listener for only a portion of the previous iterations, for example the last ten or the last hundred iterations.

From these data, a movement speed of the listener is calculated in step S35. The movement speed may be calculated in meters per iteration. The speed of the listener may be zero.

In step S36, the forgetting factor $\gamma(n)$ is calculated according to the formula described above:

$$\gamma(n) = \gamma_{max} \times \left(\frac{m}{\lambda}\right)^{\alpha},$$

In step S37, the forgetting factor $\gamma(n)$ is modified if necessary, according to the result of the calculation in step S36.

The calculation and modification of the forgetting factor in step S37 serves to calculate the weights to be applied to the control signals of the loudspeakers. More precisely, in the first iteration, the weights are initialized to zero (step S38). Each loudspeaker produces an unweighted control signal. Then, at each iteration, the value of the weights varies according to the error and to the forgetting factor (step S39). The loudspeakers then produce the accordingly weighted control signal.

The weights are calculated as described above with reference to FIGS. 2*a* and 2*b*, according to the formula:

$$q(n+1)=q(n)(1-\mu\gamma(n))+\mu G^{H}(n)(G(n)q(n)-Pt(n)).$$

The filters FILT to be applied to the loudspeakers are then determined in step S40. One filter per loudspeaker HP is calculated for example. There can therefore be as many filters as there are loudspeakers. The type of filters applied to each loudspeaker comprises for example an inverse Fourier transform.

The filters are then applied to the audio signal to be reproduced S(U) which has been obtained in step S41. Step S41 is an initialization step, implemented only during the first iteration of the method. The audio signal to be reproduced S(U) is respectively intended for the listener U. In step S42, the filters FILT are applied to the signal S(U) in order to obtain N filtered control signals $S(HP_1, \ldots, HP_N)$ to be respectively produced by the loudspeakers $(HP_1, \ldots, HP_N)$ in step S43. The control signals S $(HP_1, \ldots, HP_N)$ are respectively produced by each loudspeaker $(HP_1, \ldots, HP_N)$ of the array of loudspeakers in step S44. Typically, the loudspeakers HP produce the control signals continuously.

Then, in each iteration, the filters FILT are calculated as a function of the signals $S(HP_1, \ldots, HP_N)$ filtered in the previous iteration and produced by the loudspeakers, as perceived by the array of microphones. The filters FILT are applied to the signal S(U) in order to obtain new control signals $S(HP_1, \ldots, HP_N)$ to be respectively produced on each loudspeaker of the array of loudspeakers.

The method is then restarted beginning with step S35, in which the sound pressures $P_1$, $P_2$ of the two sub-areas SZ1. SZ2 are estimated.

Of course, the invention is not limited to the embodiments described above. It extends to other variants.

For example, the method can be implemented for a plurality of listeners $U_1$ to $U_N$. In this embodiment, an audio signal $S(U_1, U_N)$ can be provided respectively for each listener. The steps of the method can thus be implemented for each of the listeners, so that the selected sound field for each listener is reproduced for that listener at his or her position, and while taking into account his or her movements. A plurality of forgetting factors can therefore be calculated for each of the listeners.

According to another variant, the selected sound field is a first sound field, and at least a second selected sound field is produced by the array of loudspeakers HP. The second selected sound field is audible in the second sub-area for a second listener and is to be rendered inaudible in the first sub-area for a first listener. The loudspeakers are supplied the first control signals such that each loudspeaker outputs a continuous audio signal corresponding to the first selected sound field, and are also supplied second control signals such that each loudspeaker outputs a continuous audio signal corresponding to the second selected sound field. The steps of the method as described above can be applied to the first sub-area SZ1, such that the second selected sound field is rendered inaudible in the first sub-area SZ1 while taking the movements of the two listeners into account.

According to another exemplary embodiment, the first and second sub-areas are not complementary. For example, in one area, a first sub-area can be defined relative to a first listener U1 and a second sub-area can be defined relative to a second listener U2. The sound field is to be rendered audible in the first sub-area and inaudible in the second sub-area. The sound field in the rest of the area may be uncontrolled.

Although the present disclosure has been described with reference to one or more examples, workers skilled in the art will recognize that changes may be made in form and detail without departing from the scope of the disclosure and/or the appended claims.

The invention claimed is:

1. A computer-assisted method for spatialized sound reproduction based on an array of loudspeakers covering an area, for the purpose of producing a selected sound field that is audible in at least one position of at least one listener in the area, wherein the loudspeakers are supplied with respective control signals so that each loudspeaker emits an audio signal continuously, the method comprising iteratively and continuously for each listener:

obtaining a current position of a listener in the area by a position sensor;

determining distances between at least one point of the area and respective positions of the loudspeakers in order to deduce the respective acoustic transfer functions of the loudspeakers at said point, the position of said point being defined dynamically as a function of the current position of the listener, said point corresponding to a position of a virtual microphone, estimating a sound pressure at said virtual microphone, at least as a function of the respective control signals of the loudspeakers, and of a respective initial weight of the control signals of the loudspeakers;

calculating an error between said estimated sound pressure and a desired target sound pressure at said virtual microphone; and calculating and applying respective weights to the control signals of the loudspeakers, as a function of said error and of a weight forgetting factor, said forgetting factor being calculated as a function of a movement of the listener, said movement being determined by a comparison between a previous position of the listener and the current position of the listener;

the calculation of the sound pressure at the current position of the listener being re-implemented as a function of the accordingly weighted respective control signals of the loudspeakers.

2. The method according to claim 1, wherein a plurality of points forming the respective positions of a plurality of virtual microphones is defined in the area in order to estimate a plurality of respective sound pressures in the area by taking into account the respective weight applied to each loudspeaker, each respectively comprising a forgetting factor, and transfer functions specific to each loudspeaker at each virtual microphone, the plurality of points being centered on the position of the listener.

3. The method according to claim 1, wherein the area comprises a first sub-area in which the selected sound field is to be rendered audible and a second sub-area in which the selected sound field is to be rendered inaudible, the first sub-area being defined dynamically as corresponding to the position of the listener and of said virtual microphone, the virtual microphone being a first virtual microphone, and the second sub-area being defined dynamically as being complementary to the first sub-area, the second sub-area being covered by at least a second virtual microphone of which the position is defined dynamically as a function of said second sub-area, the method further comprising iteratively:

estimating a sound pressure in the second sub-area, at least as a function of the respective control signals of the loudspeakers, and of a respective initial weight of the control signals of the loudspeakers;

calculating an error between said estimated sound pressure in the second sub-area and a desired target sound pressure in the second sub-area; and calculating and applying respective weights to the control signals of the loudspeakers, as a function of said error and of a weight forgetting factor, said forgetting factor being calculated as a function of a movement of the listener, said movement being determined by a comparison between a previous position of the listener and the current position of the listener;

the calculation of the sound pressure in the second sub-area being re-implemented as a function of the respective accordingly weighted control signals of the loudspeakers.

4. The method according to claim 1, wherein the area comprises a first sub-area in which the selected sound field is to be rendered audible and a second sub-area in which the selected sound field is to be rendered inaudible, the second sub-area being defined dynamically as corresponding to the position of the listener and of said virtual microphone, the virtual microphone being a first virtual microphone, and the first sub-area being defined dynamically as being complementary to the second sub-area, the first sub-area being covered by at least a second virtual microphone of which the position is defined dynamically as a function of said first sub-area the method further comprising iteratively:

estimating a sound pressure in the second sub-area, at least as a function of the respective control signals of the loudspeakers, and of a respective initial weight of the control signals of the loudspeakers;

calculating an error between said estimated sound pressure in the second sub-area and a desired target sound pressure in the second sub-area; and calculating and applying respective weights to the control signals of the loudspeakers, as a function of said error and of a weight forgetting factor, said forgetting factor being calculated as a function of a movement of the listener, said movement being determined by a comparison between a previous position of the listener and the current position of the listener;

the calculation of the sound pressure in the second sub-area being re-implemented as a function of the respective weighted control signals of the loudspeakers.

5. The method according to claim 3 wherein each sub-area comprises at least one virtual microphone and two loudspeakers, and preferably each sub-area comprises at least ten virtual microphones and at least ten loudspeakers.

6. The method according to claim 1, wherein the value of the forgetting factor:

increases if the listener moves;

decreases if the listener does not move.

7. The method according to claim 1, wherein the forgetting factor is defined by:

$$\gamma(n) = \gamma_{max} \times \left(\frac{m}{\chi}\right)^{\alpha},$$

where $\gamma(n)$ is the forgetting factor, n a current iteration, $\gamma_{max}$ a maximum forgetting factor, $\chi$ a defined parameter equal to an adaptation increment $\mu$, m a variable defined as a function of a movement of the listener having $\chi$ as its maximum, and $\alpha$ a variable to enable adjusting a rate of increase or decrease of the forgetting factor.

8. The method according to claim 7, wherein an upward increment $l_u$ and a downward increment $l_d$ of the forgetting factor are defined such that:

if a movement of the listener is determined, $m=\min(m+l_u, 1)$, if no movement of the listener is determined, $m=\max(m-l_d, 0)$, where $0<l_u<1$ and $0<l_d<1$, the upward and downward increments being defined as a function of a movement speed of a listener and/or of a modification of the sound field selected for reproduction.

9. The method according to claim 1, wherein the forgetting factor is between 0 and 1.

10. A spatialized sound reproduction system based on an array of loudspeakers covering an area, for the purpose of producing a selected sound field that is selectively audible at a position of a listener in the area, wherein the system comprises:

a processing unit configured to process and implement a computer-assisted method for spatialized sound reproduction based on an array of loudspeakers covering an area, for the purpose of producing a selected sound field that is audible in at least one position of at least one listener in the area, wherein the loudspeakers are supplied with respective control signals so that each loudspeaker emits an audio signal continuously, the method comprising iteratively and continuously for each listener:

obtaining a current position of a listener in the area by a position sensor;

determining distances between at least one point of the area and respective positions of the loudspeakers in order to deduce the respective acoustic transfer functions of the loudspeakers at said point, the position of said point being defined dynamically as a function of the current position of the listener, said point corresponding to a position of a virtual microphone, estimating a sound pressure at said virtual microphone, at least as a function of the respective control signals of the loudspeakers, and of a respective initial weight of the control signals of the loudspeakers;

calculating an error between said estimated sound pressure and a desired target sound pressure at said virtual microphone; and calculating and applying respective weights to the control signals of the loudspeakers, as a function of said error and of a weight forgetting factor, said forgetting factor being calculated as a function of a movement of the listener, said movement being determined by a comparison between a previous position of the listener and the current position of the listener;

the calculation of the sound pressure at the current position of the listener being re-implemented as a function of the accordingly weighted respective control signals of the loudspeakers.

11. A non-transitory computer-readable storage medium comprising a computer program stored thereon and loadable into a memory associated with a processor, and comprising portions of code for implementing, during execution of said program by the processor, a computer-assisted method for spatialized sound reproduction based on an array of loudspeakers covering an area, for the purpose of producing a selected sound field that is audible in at least one position of at least one listener in the area, wherein the loudspeakers are supplied with respective control signals so that each loudspeaker emits an audio signal continuously, the method comprising iteratively and continuously for each listener:

obtaining a current position of a listener in the area by a position sensor;

determining distances between at least one point of the area and respective positions of the loudspeakers in order to deduce the respective acoustic transfer functions of the loudspeakers at said point, the position of said point being defined dynamically as a function of the current position of the listener, said point corresponding to a position of a virtual microphone, estimating a sound pressure at said virtual microphone, at least as a function of the respective control signals of the loudspeakers, and of a respective initial weight of the control signals of the loudspeakers;

calculating an error between said estimated sound pressure and a desired target sound pressure at said virtual microphone; and calculating and applying respective weights to the control signals of the loudspeakers, as a function of said error and of a weight forgetting factor, said forgetting factor being calculated as a function of a movement of the listener, said movement being determined by a comparison between a previous position of the listener and the current position of the listener;

the calculation of the sound pressure at the current position of the listener being re-implemented as a function of the accordingly weighted respective control signals of the loudspeakers.

12. The method according to claim 4, wherein each sub-area comprises at least one virtual microphone and two loudspeakers, and preferably each sub-area comprises at least ten virtual microphones and at least ten loudspeakers.

* * * * *